US011384649B1

(12) United States Patent
Rambo

(10) Patent No.: US 11,384,649 B1
(45) Date of Patent: Jul. 12, 2022

(54) HEAT EXCHANGER AND FLOW MODULATION SYSTEM

(71) Applicant: General Electric Company, Schenectady, NY (US)

(72) Inventor: Jeffrey Douglas Rambo, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/173,388

(22) Filed: Feb. 11, 2021

(51) Int. Cl.

| | |
|---|---|
| ***F01D 25/12*** | (2006.01) |
| ***F01D 9/02*** | (2006.01) |
| ***F01D 9/06*** | (2006.01) |
| *F01D 5/08* | (2006.01) |

(52) U.S. Cl.
CPC ..... *F01D 9/02* (2013.01); *F01D 9/065* (2013.01); *F01D 25/12* (2013.01); *F01D 5/08* (2013.01); *F05D 2220/32* (2013.01)

(58) Field of Classification Search
CPC ..... F05D 2220/32; F01D 9/02; F01D 25/12; F01D 25/08; F01D 5/08; F01D 5/085; F01D 5/182; F01D 5/187; F01D 5/188; F01D 9/065
See application file for complete search history.

(56) References Cited

U.S. PATENT DOCUMENTS

| | | | | |
|---|---|---|---|---|
| 5,203,163 | A * | 4/1993 | Parsons | F02C 6/08 60/785 |
| 7,810,312 | B2 | 10/2010 | Stretton et al. | |
| 7,886,520 | B2 | 2/2011 | Stretton et al. | |
| 8,826,641 | B2 | 9/2014 | Suciu et al. | |
| 9,206,912 | B2 | 12/2015 | Landre et al. | |
| 9,243,563 | B2 | 1/2016 | Lo | |
| 9,267,390 | B2 | 2/2016 | Lo | |
| 9,803,557 | B2 | 10/2017 | Farah et al. | |
| 9,885,313 | B2 | 2/2018 | Baltas | |
| 10,240,536 | B2 | 3/2019 | Bagnall et al. | |
| 10,337,406 | B2 | 7/2019 | Suciu et al. | |
| 10,443,428 | B2 | 10/2019 | Xu | |
| 2014/0202158 | A1* | 7/2014 | Storage | F02C 7/14 60/722 |
| 2015/0330309 | A1* | 11/2015 | Bagnall | F02K 3/115 60/785 |
| 2016/0312702 | A1 | 10/2016 | Thomas | |
| 2016/0369697 | A1 | 12/2016 | Schwarz et al. | |
| 2017/0254268 | A1 | 9/2017 | Lord et al. | |
| 2018/0355739 | A1 | 12/2018 | Zysman | |
| 2019/0145264 | A1* | 5/2019 | Jonnalagadda | F01D 9/041 415/115 |

* cited by examiner

*Primary Examiner* — Jacob M Amick
(74) *Attorney, Agent, or Firm* — Dority & Manning, P.A.

(57) ABSTRACT

A propulsion system is provided including a first vane extended along the radial direction. The first vane is configured to rotate relative to a vane axis extended along the radial direction. A second vane is extended along the radial direction. The second vane is positioned aft along the axial direction of the first vane. The second vane forms an inlet opening proximate to a second vane leading edge, and the second vane forms an outlet opening proximate to a second vane trailing edge. The inlet opening and the outlet opening together allow a flow of fluid through the second vane. A heat exchanger is positioned within the second vane. The inlet opening and the outlet opening allow the flow of fluid in fluid communication with the heat exchanger.

20 Claims, 7 Drawing Sheets

HEAT EXCHANGER AND FLOW MODULATION SYSTEM

FIELD

The present subject matter relates generally to heat exchanger systems and systems for flow modulation therefor. The present subject matter relates particularly to heat exchanger and flow modulation systems for gas turbine engines and propulsion systems.

BACKGROUND

Propulsion systems and gas turbine engines are challenged with thermal management of increasingly higher thermal loads. The increasingly higher thermal loads are due in part to increasingly higher energy requirements from vehicles attached to the propulsion systems and gas turbine engines. The higher energy requirements are due in part to increasing electrification of vehicles such as aircraft or increased ability of propulsion systems and gas turbine engines to generate electricity or require greater electric loads.

Higher thermal loads may also result from improved engine designs and materials that allow for systems to generate and withstand higher temperatures. Higher operating temperatures may require lubricants and fuels to receive larger magnitudes of heat and thermal energy.

It is significant that improved engine designs are not adversely offset by inefficient heat exchange systems. Conventional heat exchange systems may operate primarily as a function of engine speed. However, such heat exchange systems may be insufficient at low speed or part-power conditions. Also, such heat exchange systems may decrease engine efficiency at high power conditions or other conditions that may require less heat transfer performance.

Conventional heat exchange systems may utilize doors, flaps, scoops, or bleed injectors. However, such systems may adversely increase engine weight such as to negate improved engine designs and materials that may reduce engine weight.

As such, there is a need for improved heat exchanger systems that can meet the needs resulting from higher thermal loads. Still further, there is a need for improved operation of heat exchange systems at part-power conditions and high power conditions.

BRIEF DESCRIPTION

Aspects and advantages of the invention will be set forth in part in the following description, or may be obvious from the description, or may be learned through practice of the invention.

A propulsion system is accordance with an aspect of present disclosure is provided. The propulsion system includes a first vane extended along the radial direction. The first vane is configured to rotate relative to a vane axis extended along the radial direction. A second vane is extended along the radial direction and is positioned aft along the axial direction of the first vane. The second vane forms an inlet opening proximate to a second vane leading edge, and the second vane forms an outlet opening proximate to a second vane trailing edge. The inlet opening and the outlet opening together allow a flow of fluid through the second vane. A heat exchanger is positioned within the second vane. The inlet opening and the outlet opening allow the flow of fluid in fluid communication with the heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
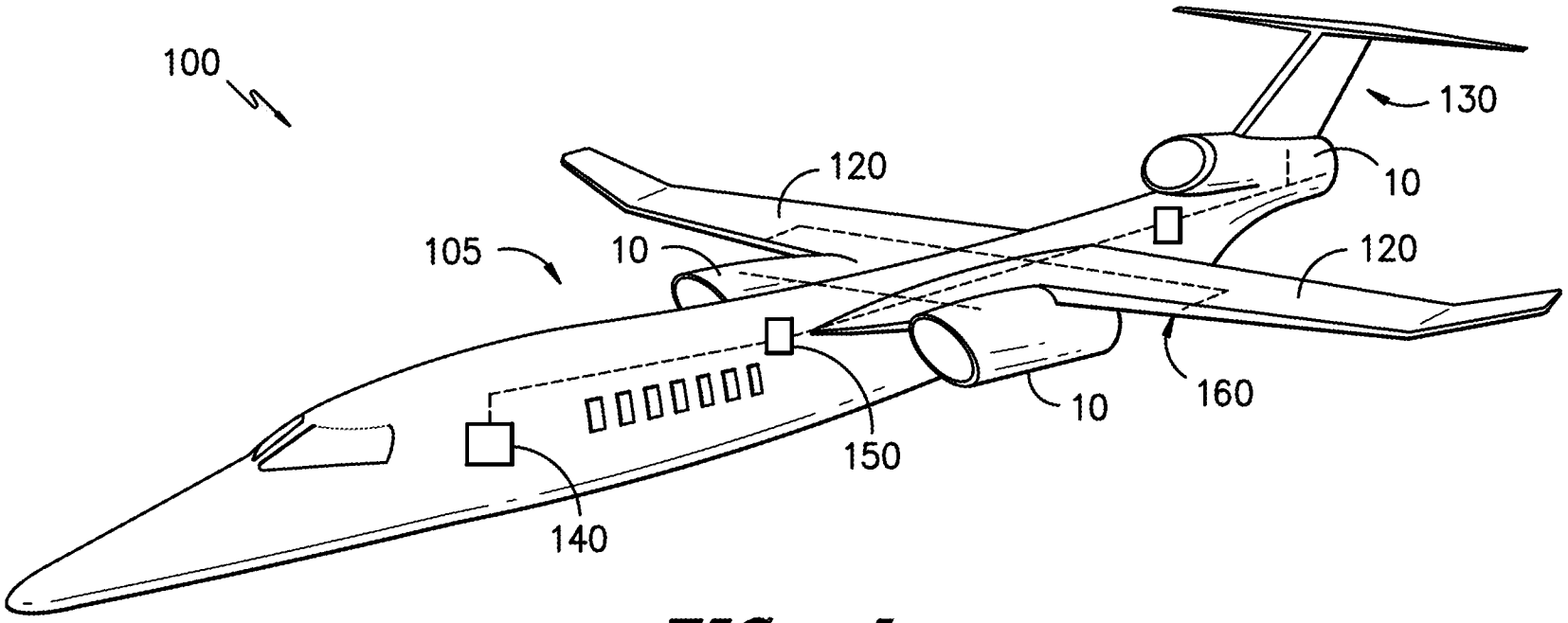
FIG. 1 is a perspective view of an exemplary vehicle including a propulsion system having a heat exchanger system in accordance with aspects of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Embodiments of a heat exchanger and flow modulation system are provided that may meet needs associated with higher thermal loads and improved operation at part-power conditions and high power conditions. Embodiments of an engine including the heat exchanger and flow modulation system include a first vane positioned at least partially forward of a second vane, in which a heat exchanger is positioned within the second vane. The first vane is articulatable to adjust a flow of fluid through an inlet opening at the second vane into thermal communication with the heat exchanger. The articulatable first vane adjusts an amount of thermal communication of the flow of fluid with the heat exchanger, such as based on operating condition of the engine or thermal loading. The first vane may be attached to a variable guide vane system, rather than doors, flaps, scoops, or bleed injectors, such as to desirably alter the amount of fluid and heat transfer with the heat exchanger.

Embodiments provided herein may avoid engine weight increases or complex systems, such as via utilizing variable vane actuator systems such as utilized for compressor sections. The flow of fluid through the second vane allows for adjusting heat exchanger frontal area via tangential flow without significantly modifying bulk flow pattern in the flowpath surrounding the vanes. Heat exchanger pods or pylons inside the vane may allow for diffusing inlet momentum to minimize cold-side pressure drop at the heat exchanger. Positioning of an outlet opening at the second vane allows the cooling fluid to flow through the second vane and discharge into a low static pressure region, such as to minimize undesired aerodynamic effects to flows outside the vanes thereacross.

Embodiments of the engine, heat exchanger, and flow modulation system may allow for adaptive cycle operation and performance from a two-stream engine (e.g., fan flow stream and core flow stream) using the variable first vane to direct flow toward the heat exchanger at the second vane during a thermal management mode. The first vane may articulate to allow flow to substantially bypass the heat exchanger during a propulsion mode.

Referring now to the drawings, in FIG. 1, an exemplary embodiment of a vehicle 100 including a propulsion system 10 and a heat exchanger system 200 according to aspects of the present disclosure is provided. In an embodiment, the vehicle 100 is an aircraft including an aircraft structure or airframe 105. The airframe 105 includes a fuselage 110 to which wings 120 and an empennage 130 are attached. The propulsion system 10 according to aspects of the present disclosure is attached to one or more portions of the airframe. In various embodiments, the heat exchanger system 200 is a system configured to articulate a vane structure to desirably provide cooling fluid, such as air or oxidizer, to a heat exchanger positioned within a downstream vane. The cooling fluid removes heat or thermal energy from one or more fluids, such as, but not limited to, liquid and/or gaseous fuel, lubricant, hydraulic fluid, pneumatic fluid, heat transfer fluid, or cooling fluid for an electric machine, electronics, computing system, environmental control system, gear assembly, or other system or structure.

In certain instances, the propulsion system 10 is attached to an aft portion of the fuselage 110. In certain other instances, the propulsion system 10 is attached underneath, above, or through the wing 120 and/or portion of the empennage 130. In various embodiments, the propulsion system 10 is attached to the airframe 105 via a pylon or other mounting structure. In still other embodiments, the propulsion system 10 is housed within the airframe, such as may be exemplified in certain supersonic military or commercial aircraft.

Figure 2:
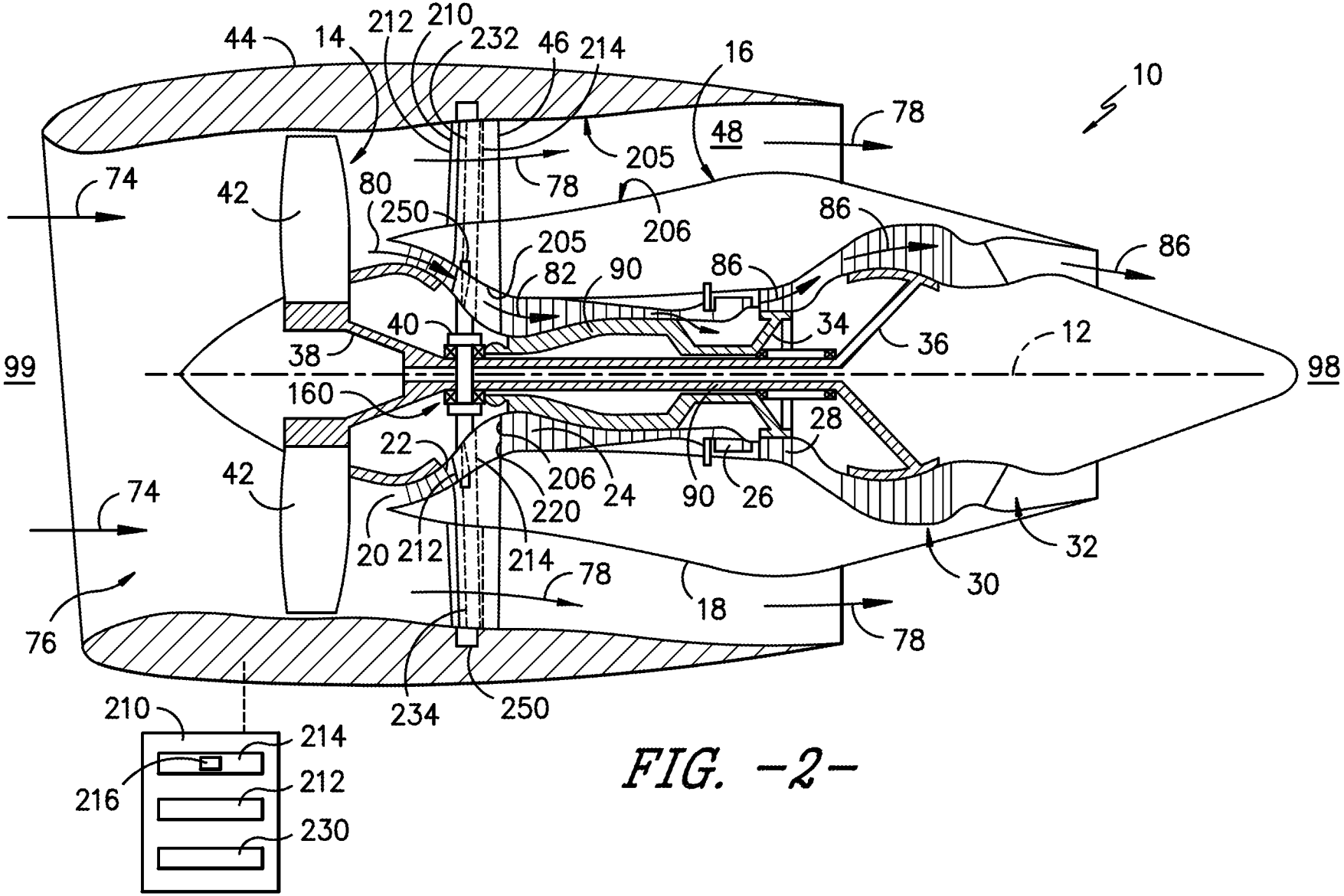
FIG. 2 is a schematic cross-sectional view of an exemplary embodiment of a propulsion system having a heat exchanger system in accordance with aspects of the present disclosure.

Referring now to the drawings, FIG. 2 is a schematic partially cross-sectioned side view of an exemplary gas turbine engine 10 herein referred to as "engine 10" as may incorporate various embodiments of the present invention. The engine 10 may particularly be configured as a gas turbine engine for an aircraft. Although further described herein as a turbofan engine, the engine 10 may define a turboshaft, turboprop, or turbojet gas turbine engine, including marine and industrial engines and auxiliary power units. As shown in FIG. 1, the engine 10 has a longitudinal or axial centerline axis 12 that extends therethrough for reference purposes. An axial direction A is extended co-directional to the axial centerline axis 12 for reference. The engine 10 further defines an upstream end 99 and a downstream end 98 for reference. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a heat addition system 26, an expansion section or turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 via a reduction gear 40 such as in an indirect-drive or geared-drive configuration.

As shown in FIG. 2, the fan assembly 14 includes a plurality of fan blades 42 that are coupled to and that extend radially outwardly from the fan shaft 38. An annular fan casing or nacelle 44 circumferentially may surround the fan assembly 14 and/or at least a portion of the core engine 16. It should be appreciated by those of ordinary skill in the art that the nacelle 44 may be configured to be supported relative to the core engine 16 by a plurality of circumferentially-spaced outlet guide vanes or struts 46. Moreover, at least a portion of the nacelle 44 may extend over an outer portion of the core engine 16 so as to define a fan flow passage 48 therebetween. However, it should be appreciated that various configurations of the engine 10 may omit the nacelle 44, or omit the nacelle 44 from extending around the fan blades 42, such as to provide an open rotor or propfan configuration of the engine 10 depicted in FIG. 3.

It should be appreciated that combinations of the shaft 34, 36, the compressors 22, 24, and the turbines 28, 30 define a rotor assembly 90 of the engine 10. For example, the HP shaft 34, HP compressor 24, and HP turbine 28 may define a high speed or HP rotor assembly of the engine 10. Similarly, combinations of the LP shaft 36, LP compressor 22, and LP turbine 30 may define a low speed or LP rotor assembly of the engine 10. Various embodiments of the engine 10 may further include the fan shaft 38 and fan blades 42 as the LP rotor assembly. In other embodiments, the engine 10 may further define a fan rotor assembly at least partially mechanically de-coupled from the LP spool via the fan shaft 38 and the reduction gear 40. Still further embodiments may further define one or more intermediate rotor assemblies defined by an intermediate pressure compressor, an intermediate pressure shaft, and an intermediate pressure turbine disposed between the LP rotor assembly and the HP rotor assembly (relative to serial aerodynamic flow arrangement).

During operation of the engine 10, a flow of air, shown schematically by arrows 74, enters an inlet 76 of the engine 10 defined by the fan case or nacelle 44. A portion of air, shown schematically by arrows 80, enters the core engine 16 through a core inlet 20 defined at least partially via the outer casing 18. The flow of air is provided in serial flow through the compressors, the heat addition system, and the expansion section via a core flowpath 70. The flow of air 80 is increasingly compressed as it flows across successive stages of the compressors 22, 24, such as shown schematically by arrows 82. The compressed air 82 enters the heat addition system 26 and mixes with a liquid and/or gaseous fuel and is ignited to produce combustion gases 86. It should be appreciated that the heat addition system 26 may form any appropriate system for generating combustion gases, including, but not limited to, deflagrative or detonative combustion systems, or combinations thereof. The heat addition system 26 may include annular, can, can-annular, trapped vortex, involute or scroll, rich burn, lean burn, rotating detonation, or pulse detonation configurations, or combinations thereof.

The combustion gases 86 release energy to drive rotation of the HP rotor assembly and the LP rotor assembly before exhausting from the jet exhaust nozzle section 32. The release of energy from the combustion gases 86 further drives rotation of the fan assembly 14, including the fan blades 42. A portion of the air 74 bypasses the core engine 16 and flows across the fan flow passage 48, such as shown schematically by arrows 78.

Figure 3:
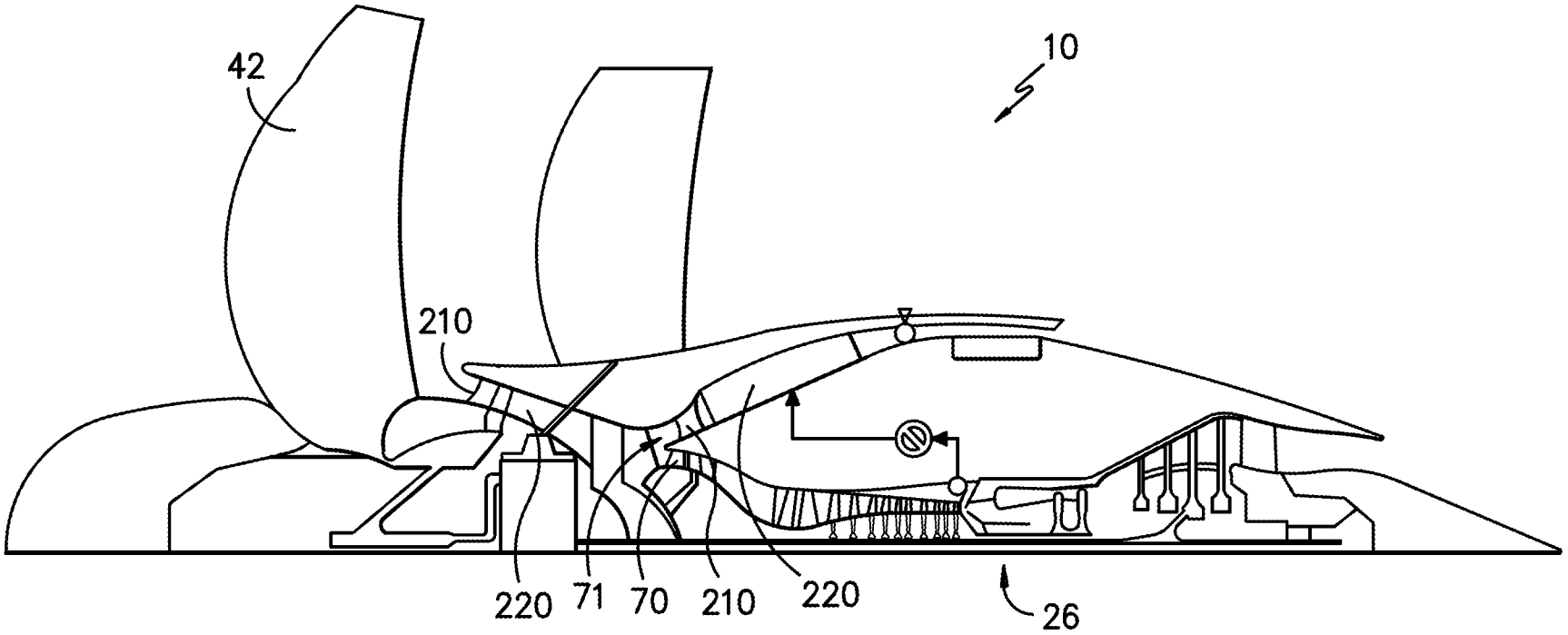
FIG. 3 is a schematic cross-sectional view of an exemplary embodiment of a propulsion system having a heat exchanger system in accordance with aspects of the present disclosure.

Referring now to FIG. 3, another exemplary embodiment of the engine 10 is provided. The embodiment provided in FIG. 3 is configured substantially similarly as described in regard to FIG. 2. In FIG. 3, the engine 10 is configured as a three-stream engine including the fan flow passage 48, the core flowpath 70, and a core bypass or third stream 71. The core flowpath 70 is extended through at least the high pressure compressor 24, the heat addition system 26, and the high pressure turbine 32. The core bypass or third stream flowpath 71 is extended from downstream of the low or intermediate pressure compressor 22 and bypasses the core flowpath 70 at the HP compressor 24 and heat addition system 26. In certain embodiments, the third stream flowpath 71 is extended into fluid communication downstream of the vanes 46 at the fan flow passage 48.

It should be appreciated that FIG. 2 depicts and describes a two-stream engine having the fan flow passage 48 and the core flowpath 70. The embodiment depicted in FIG. 2 has a nacelle 44 surrounding the fan blades 42, such as to provide noise attenuation, blade-out protection, and other benefits known for nacelles. FIG. 3 depicts and describes a three-stream engine having the fan flow passage 48, the core flowpath 70, and the third stream flowpath 71. The embodiment depicted in FIG. 3 is configured with the fan blades 42 being unducted by a nacelle, such as to form an open rotor engine. In various embodiments, the unducted open rotor engine may form a two-stream engine such as described with regard to FIG. 2. Alternatively, the ducted engine including the nacelle 44 may form a three-stream engine such as described in regard to FIG. 3. Still further embodiments may position the heat exchanger and flow modulation system further described herein in an engine forming a ramjet, a supersonic combustion ramjet (scramjet), a turboprop gas turbine engine, a turboshaft gas turbine engine, or a turbojet engine.

Referring now to FIGS. 4-7, perspective views of embodiments of a heat exchanger system 200 are provided. Embodiments of the system 200 include a first vane 210 extended along the radial direction R. The first vane 210 is operably connected to an actuation system 250 configured to rotate the first vane 210 relative to a vane axis 216 extended along the radial direction R. A second vane 220 is extended along the radial direction R. The second vane 220 is positioned aft along the axial direction A of the first vane 210.

The vanes generally form airfoils each having a leading edge, a trailing edge, a pressure side, and a suction side. The second vane 220 forms an inlet opening 226 proximate to a second vane leading edge 222. The second vane 220 forms an outlet opening 228 proximate to a second vane trailing edge 224. The inlet opening 226 and the outlet opening 228 together allow a flow of fluid, such as air or oxidizer generally described in regard to the engine 10 in FIGS. 2-3, through the second vane 220.

A heat exchanger 230 is positioned within the second vane 220. The inlet opening 226 and the outlet opening 228 allow for the flow of fluid to enter into fluid communication with the heat exchanger 230. In various embodiments, the heat exchanger 230 includes a supply conduit 234 and a return conduit 232. Each conduit includes walls allowing for a flow of a thermal load into the heat exchanger 230. The heat exchanger 230 fluidly separates the flow of the thermal load from the flow of fluid allowed to flow through second vane 220. The supply conduit 234 is configured to provide the flow of the thermal load into the heat exchanger 230. The return conduit 232 is configured to remove the flow of the thermal load from the heat exchanger 230. In a particular embodiment, the supply conduit 234 is positioned proximate to an aft or trailing edge 224 of the second vane 220 and the return conduit 232 is positioned proximate to a forward or leading edge 222 of the second vane 220. As such, the thermal load flowing through the heat exchanger 230 is provided in counter-flow relative to the flow of fluid through the second vane 220, such as to improve heat transfer.

Referring back to FIGS. 2-3, and in conjunction with FIGS. 4-7, in certain embodiments, the engine 10 includes an outer radial wall 205 extended along the axial direction A and an inner radial wall 206 extended substantially co-directional to the outer radial wall 205. The outer radial wall 205 and the inner radial wall 206 together form a flowpath extended substantially along the axial direction A. In various embodiments, the flowpath is the fan flow passage 48, the core flowpath 70, or the third stream flowpath 71. The first vane 210 and the second vane 220 are each extended along the radial direction R through the flowpath.

In one embodiment, the outer radial wall 205 and the inner radial wall 206 form an inlet section configured to receive the flow of fluid into the flowpath, such as depicted and described at the inlet 20 at the compressor section. In such an embodiment, the first vane 210 and the second vane 220 are extended through the core flowpath 70. In a particular embodiment, the first vane 210 and the second vane 220 are extended through the core flowpath at the compressor section, such as at the intermediate or low pressure compressor 22. In still another embodiment, the first vane 210 and the second vane 220 may be extended at the core flowpath 70 between the LP compressor 22 and the HP compressor 24.

In another embodiment, the outer radial wall 205 is formed at the nacelle 44, such as depicted in FIG. 2. The first vane 210 and the second vane 220 are positioned aft along the axial direction A of the plurality of fan blades 42. The inner radial wall 206 is formed at the outer casing 16 of the core engine 18. The flowpath includes at least a portion of the fan flow passage 48. The first vane 210 and the second vane 220 are extended through the fan flow passage 48.

In still another embodiment, such as depicted in FIG. 3, the first vane 210 and the second vane 220 are extended through the flowpath formed by the third stream passage 71.

In yet another embodiment, the first vane 210 and the second vane 220 are extended from the outer casing 16 of the core engine 18 into the fan flow passage 48. In a particular embodiment, such as depicted in FIG. 3, the first vane 210 and the second vane 220 are extended from the outer casing 16 into the fan flow passage 48 of an unducted rotor engine.

Various embodiments of the system 200 may include a plurality of the first vane 210 positioned in circumferential arrangement. The system 200 may further include a plurality of the second vane 220 positioned in circumferential arrangement. In particular embodiments, the inlet opening 226 is positioned through the pressure side 227 of the second vane 220. In a still particular embodiment, the outlet opening 228 is positioned through a suction side 229 of the second vane 220.

Figure 6:
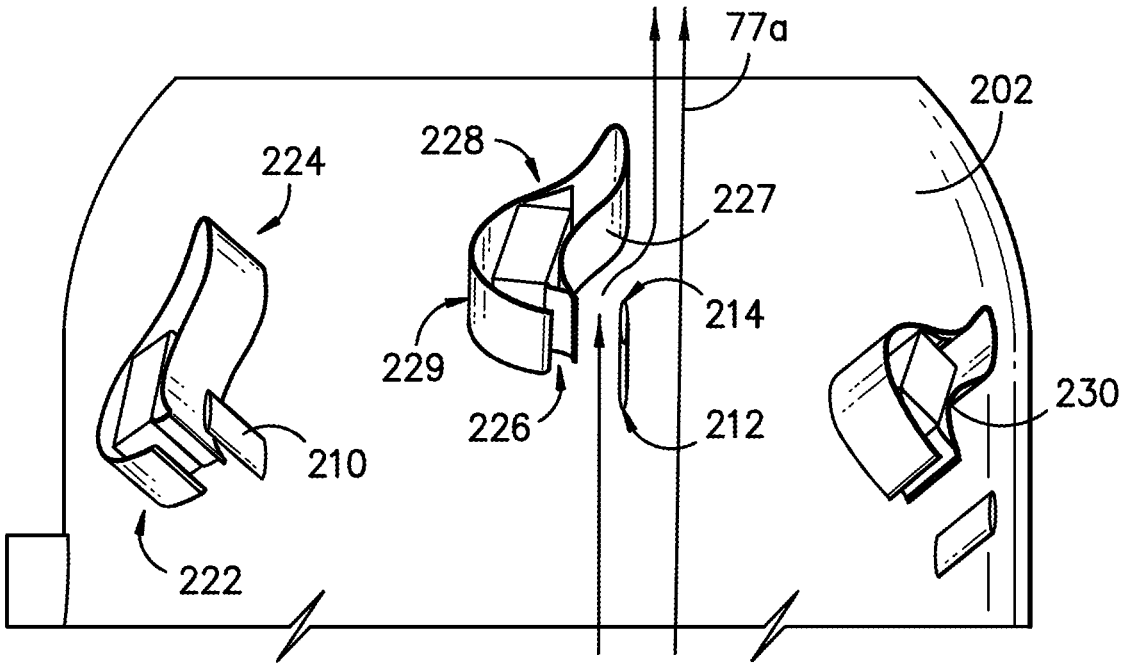
FIG. 6 is a perspective view of an exemplary embodiment of the heat exchanger system in a closed position accordance with aspects of the present disclosure.
Figure 7:
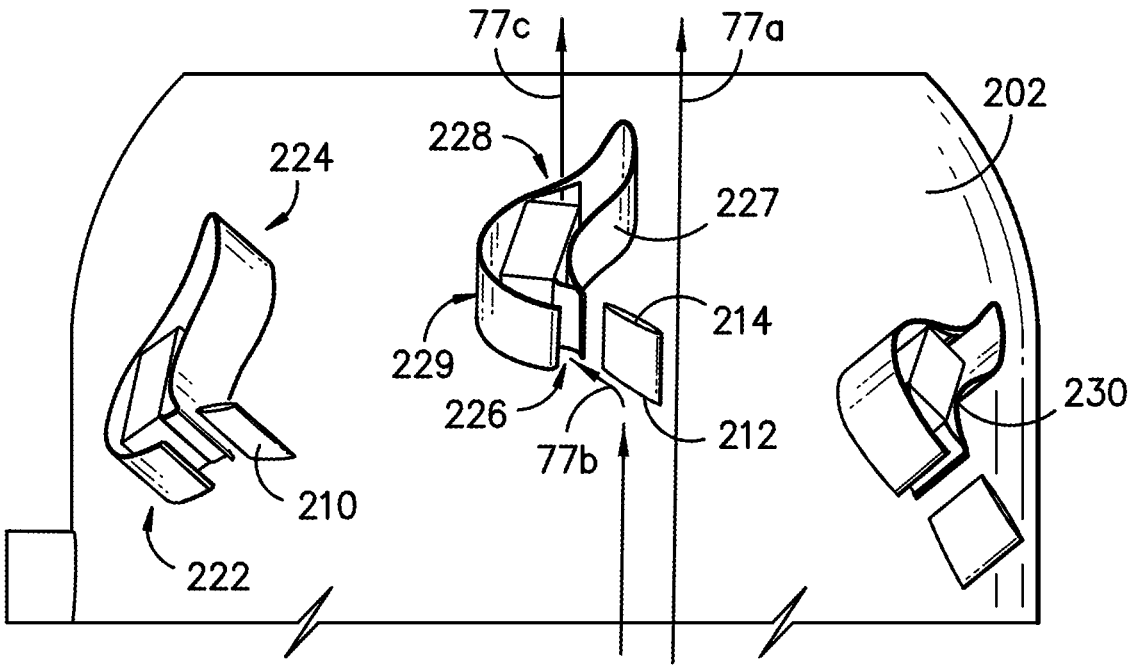
FIG. 7 is a perspective view of the exemplary embodiment of the heat exchanger system of FIG. 6 in an open position accordance with aspects of the present disclosure.
Figure 8:
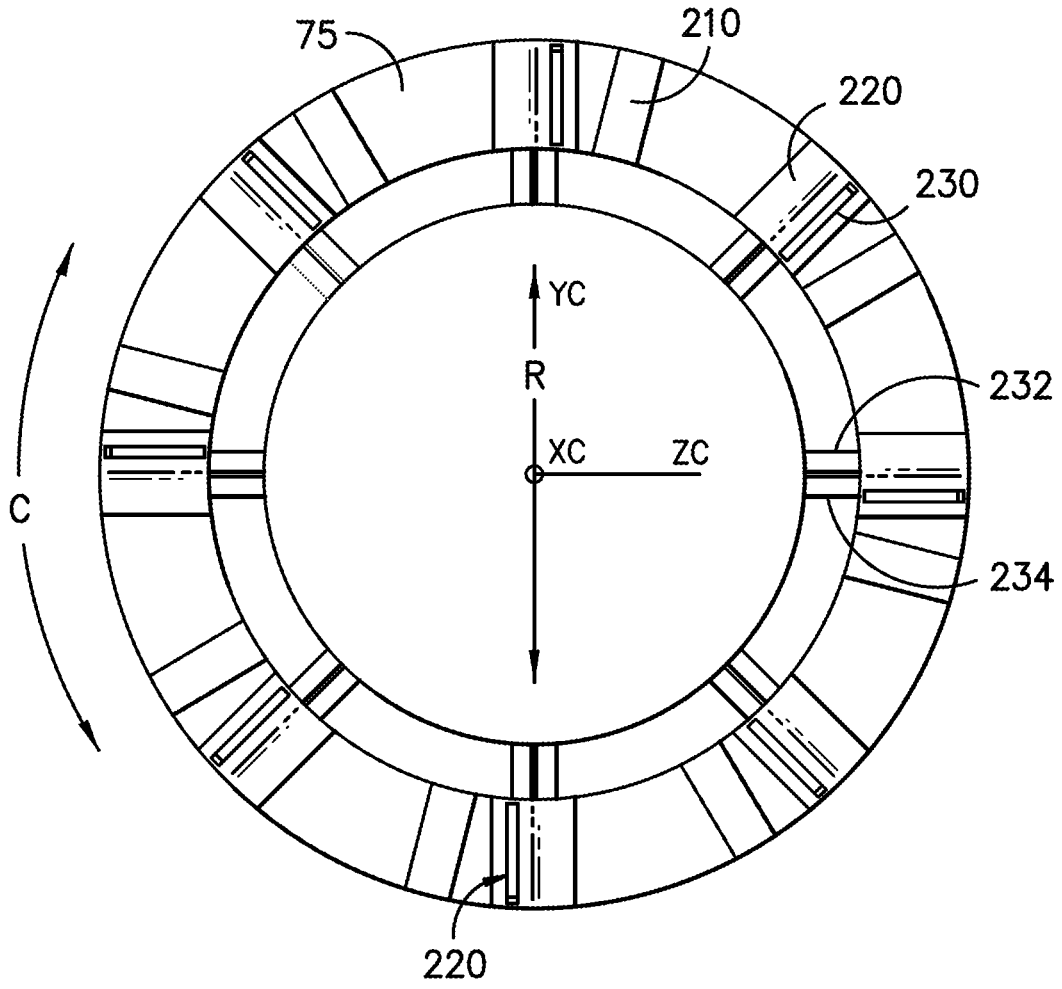
FIG. 8 is a circumferential view of an embodiment of a heat exchanger in accordance with aspects of the present disclosure.

Referring briefly to FIG. 8, a circumferential view from upstream looking downstream of an exemplary embodiment of the system 200 of FIGS. 4-7 is provided. Figs. Certain embodiments of the system 200 position the first vane 210 offset along the circumferential direction C from the second vane 220. As such, the first vane 210 and the second vane 220 are positioned at circumferential locations different from one another.

Referring back to FIGS. 4-7, the first vane 210 includes a first vane trailing edge 214 and a first vane leading edge 212. In certain embodiments, the first vane trailing edge 214 is co-axial to at least at portion of the second vane leading edge 222. In a particular embodiment, the first vane trailing edge 214 is co-axial to the inlet opening 226 at the second vane 210.

Figure 4:
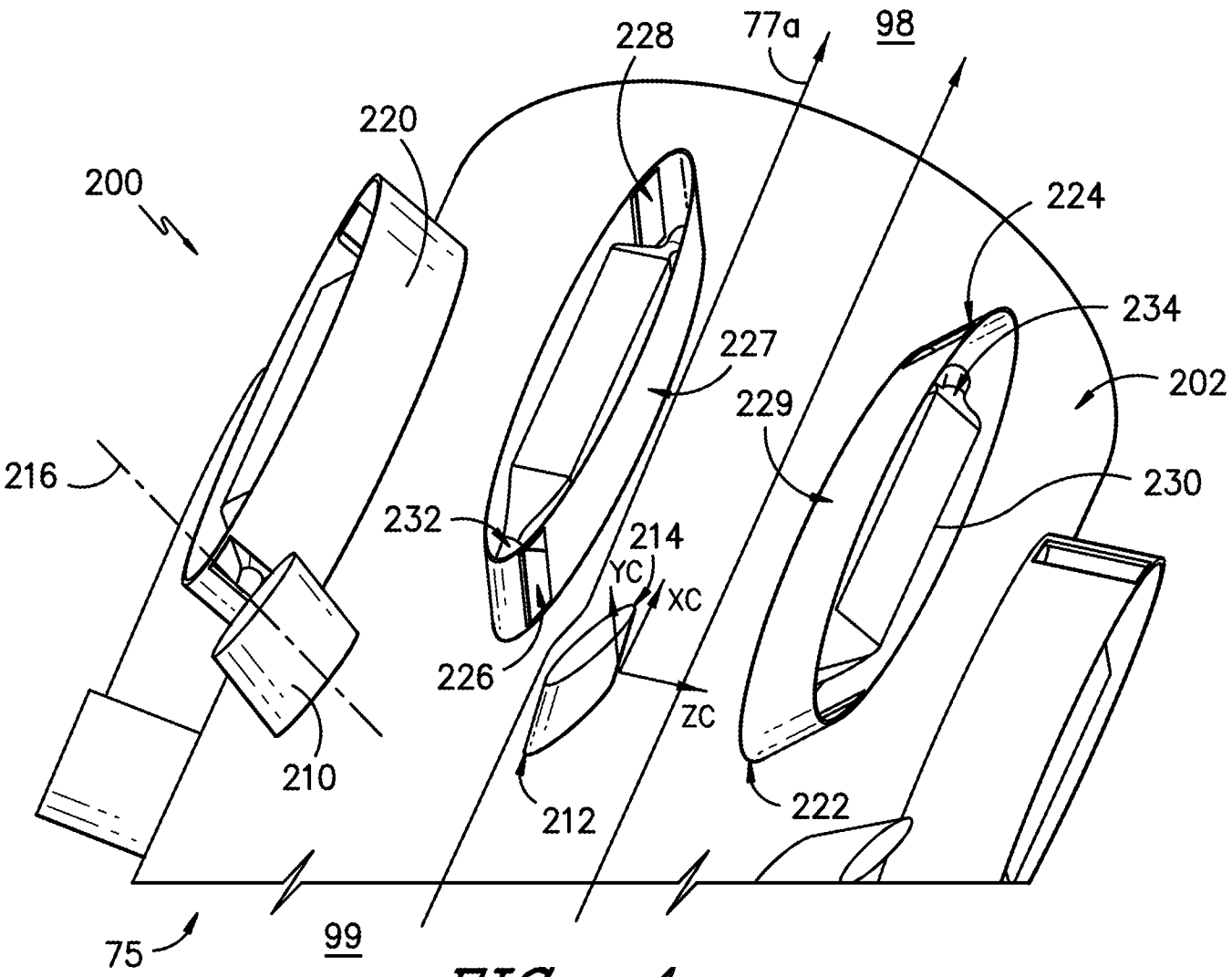
FIG. 4 is a perspective view of an exemplary embodiment of the heat exchanger system in a closed position accordance with aspects of the present disclosure.
Figure 5:
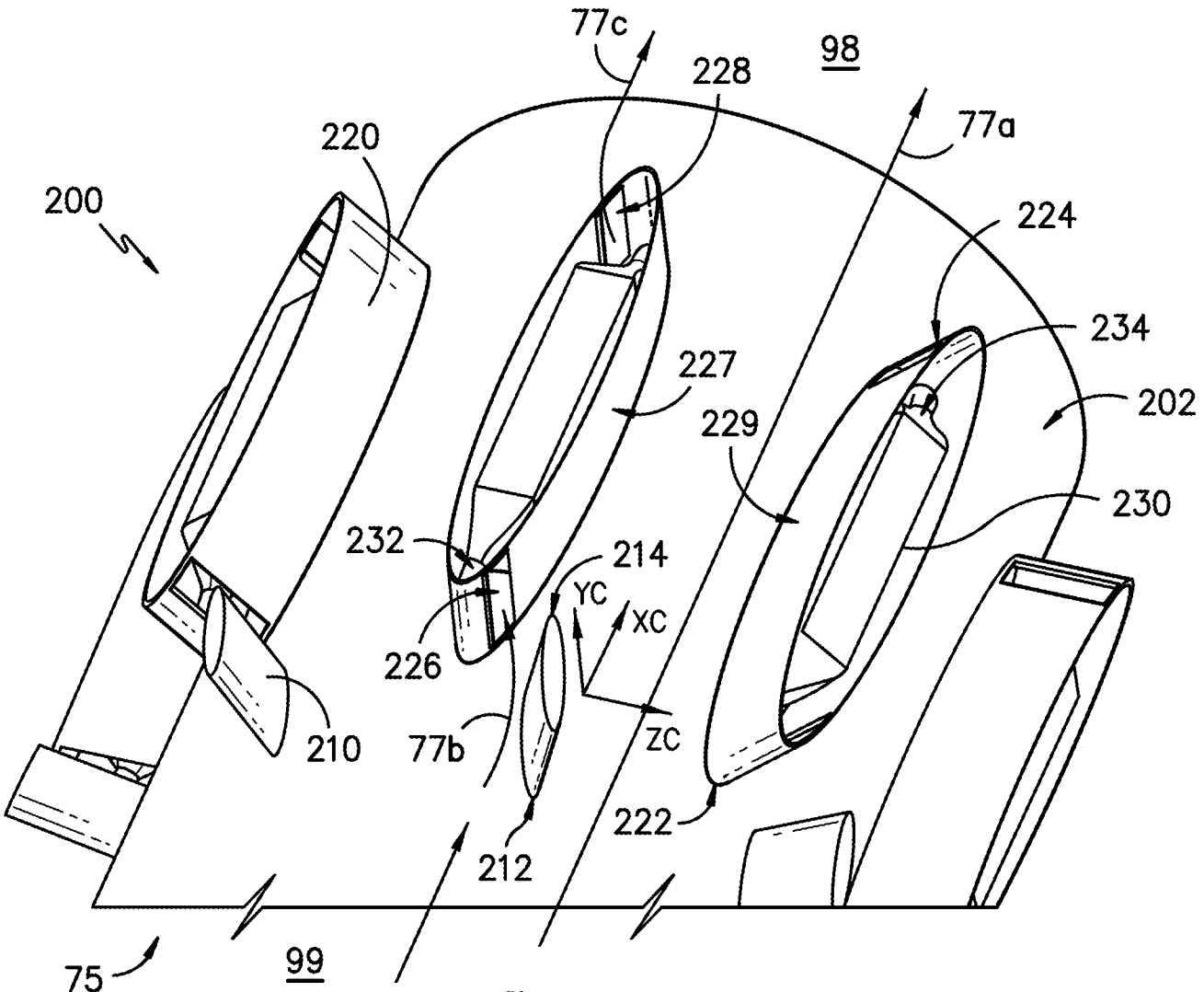
FIG. 5 is a perspective view of the exemplary embodiment of the heat exchanger system of FIG. 4 in an open position accordance with aspects of the present disclosure.

During operation of the engine 10 such as described above, the first vane 210 is configured to actively adjust, modulate, alter, or otherwise direct the flow of fluid into the inlet opening 226 of the second vane 210 (such as depicted in FIG. 5 and FIG. 7) or away from the inlet opening 226 (such as depicted in FIG. 4 and FIG. 6) via rotation of the first vane 210 along the vane axis 216. The flow of fluid, such as air or oxidizer generally, is provided through the flowpath 75 such as described above with regard to the fan flow passage 48, the core flowpath 70, or the third stream flowpath 71. When the first vane 210 is modulated to an open position, such as depicted in FIG. 4 and FIG. 6, the flow of fluid, depicted schematically via arrows 77*a*, passes across the first vane 210 and the second vane 220 without substantially entering the second vane 220 through the inlet opening 226. when the first vane 210 is modulated to a closed position, such as depicted in FIG. 5 and FIG. 7, a portion of the flow of fluid, depicted schematically via arrows 77*b*, is directed into the second vane 220 into thermal communication with the heat exchanger 230.

In various embodiments, the flow of the thermal load flowing through the heat exchanger 230 is one or more of a flow of lubricant, a flow of fuel, a flow of hydraulic fluid, or a flow of heat transfer fluid, or combinations thereof. During operation of the engine 10, the first vane 210 is actuated along its vane axis 216 to adjust a mass flow or volumetric flow of cooling fluid, such as the air or oxidizer generally depicted via arrows 77*b*, directed into thermal communication with the heat exchanger 230 within the second vane 220. Increased transfer of heat or thermal energy from the thermal load at the heat exchanger 230 is generated by closing the first vane 210 to direct greater amounts of cooling fluid 77*b* into the second vane 220. The flow of cooling fluid is allowed to egress from the second vane 220 through the outlet opening 228, such as depicted in FIG. 5 and FIG. 7 via arrows 77*c*.

Modulation of the first vane 210 allows for altering aerodynamics at a duct forming the flowpath 75, such as to allow the heat exchanger 230 to capture total pressure and discharge the flow of fluid 77*c* into a relatively low static pressure region at the suction side 228 of the second vane 220. The second vane 220 may include features to sink the flow of fluid 77*b* into static pressure. Such features may include the particular positions of the inlet opening 226, the outlet opening 228, the first vane 210 relative to the adjacent second vane 220, or a surface roughness, bumps, ridges, protrusions, perturbations, or dimples at or inside the second vane 220.

Methods for operation include one or more steps such as described above. Additional steps may include modulating the first vane 210 into an increased thermal attenuation mode via closing the first vane 210 and directing the flow of fluid into inlet opening 226 at the second vane 220. Steps may further include modulating the first vane 210 into a propulsion mode via opening the first vane 210 and directing the flow of fluid away from the inlet opening 226. As such, the thermal attenuation mode directs increased flow into thermal communication with the heat exchanger 230 and the propulsion mode directs less flow into the thermal communication with the heat exchanger 230. Certain embodiments may correspond the propulsion mode to a high-power output (e.g., takeoff or climb-out power in a landing-takeoff cycle) of the engine 10. Still certain embodiments may correspond the thermal attenuation mode to a low-power or part-power output (e.g., idle or cruise condition in a landing-takeoff cycle).

Embodiments of the heat exchanger 200 provided herein may improve overall engine efficiency and thermal management performance without adversely impacting engine weight or aerodynamics. Embodiments provided herein allow for adjusting an effective frontal area of the heat exchanger 230, such as may indicate heat transfer at the heat exchanger 230, via allowing a tangential flow through the second vane 220 without significantly altering bulk flow pattern of the flow of fluid directed downstream.

Referring back to FIGS. 2-3, the system may further include a computing system 210 configured to obtain, measure, or otherwise send and receive signals to modulate, open, close, adjust, rotate, or otherwise selectively actuate the first vane 210 to permit or disable the flow of air, or oxidizer generally, through the second vane 220 such as described herein.

The computing system 210 can correspond to any suitable processor-based device, including one or more computing devices, such as described above. In certain embodiments, the computing system 210 is a full-authority digital engine controller (FADEC) for a gas turbine engine, or other computing module or controller configured to execute instructions for operating a gas turbine engine. For instance, FIG. 2 and FIG. 3 illustrate one embodiment of suitable components that can be included within the computing system 210. The computing system 210 can include a processor 212 and associated memory 214 configured to perform a variety of computer-implemented functions.

As shown, the computing system 210 can include control logic 216 stored in memory 214. The control logic 216 may include instructions that when executed by the one or more processors 212 cause the one or more processors 212 to perform operations. Additionally, the computing system 210 can also include a communications interface module 230. In several embodiments, the communications interface module 230 can include associated electronic circuitry that is used to send and receive data. As such, the communications interface module 230 of the computing system 210 can be used to send and/or receive data to/from engine 10 and the heat exchanger system 200. In addition, the communications interface module 230 can also be used to communicate with any other suitable components of the heat exchanger system 200, such as the first vane 210 or the actuation system 250.

It should be appreciated that the communications interface module 230 can be any combination of suitable wired and/or wireless communications interfaces and, thus, can be communicatively coupled to one or more components of the compressor section or the engine via a wired and/or wireless connection.

Embodiments of the actuation system 250 for the first vane 210 may include a variable guide vane (VGV) system including synchronization rings, clevises, actuators, and linkages as may generally be utilized for compressor sections. Still other embodiments of the actuation system 250 for the first vane 210 may include a pitch adjustment mechanism including motors, rings, clevises, actuators, or linkages as may generally be utilized for fan or propeller blades or vanes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects of the invention are provided by the subject matter of the following clauses:

1. A propulsion system defining an axial centerline axis, an axial direction co-directional to the centerline axis, a radial direction extended from the centerline axis, and a circumferential direction extended relative to the centerline axis, the system including a first vane extended along the radial direction, and wherein the first vane is configured to rotate relative to a vane axis extended along the radial direction; a second vane extended along the radial direction, and wherein the second vane is positioned aft along the axial direction of the first vane, wherein the second vane forms an inlet opening proximate to a second vane leading edge, and wherein the second vane forms an outlet opening proximate to a second vane trailing edge, wherein the inlet opening and the outlet opening together allow a flow of fluid through the second vane; and a heat exchanger positioned within the second vane, wherein the inlet opening and the outlet opening allow the flow of fluid in fluid communication with the heat exchanger.

2. The system of any one or more clauses herein, wherein the first vane is configured to direct the flow of fluid into the inlet opening of the second vane via rotation of the first vane along the vane axis to a closed position.

3. The system of any one or more clauses herein, wherein the first vane is configured to direct the flow of fluid away from the inlet opening of the second vane via rotation of the first vane along the vane axis to an open position.

4. The system of any one or more clauses herein, the system including a plurality of the first vane positioned in circumferential arrangement.

5. The system of any one or more clauses herein, the system including a plurality of the second vane positioned in circumferential arrangement.

6. The system of any one or more clauses herein, wherein the inlet opening is positioned through a pressure side of the second vane.

7. The system of any one or more clauses herein, wherein the outlet opening is positioned through a suction side of the second vane.

8. The system of any one or more clauses herein, wherein the first vane is offset along the circumferential direction from the second vane.

9. The system of any one or more clauses herein, wherein a first vane trailing edge is co-axial to at least the second vane leading edge.

10. The system of any one or more clauses herein, wherein the first vane trailing edge is co-axial to the inlet opening at the second vane.

11. The system of any one or more clauses herein, the system including an outer radial wall extended along the axial direction; and an inner radial wall extended co-directional to the outer radial wall, wherein the outer radial wall and the inner radial wall together form a flowpath extended substantially along the axial direction, and wherein the first vane and the second vane are each extended along the radial direction through the flowpath.

12. The system of any one or more clauses herein, wherein the outer radial wall and the inner radial wall form an inlet section configured to receive the flow of fluid into the flowpath.

13. The system of any one or more clauses herein, the system including a fan section comprising a plurality of fan blades, wherein a nacelle surrounds the plurality of fan blades, and wherein the outer radial wall is formed at the nacelle, and wherein the first vane and the second vane are positioned aft along the axial direction of the plurality of fan blades; and a core engine, wherein an outer casing surrounds the core engine, and wherein the inner radial wall is formed at the outer casing.

14. The system of any one or more clauses herein, the system including a compressor section including a plurality of compressor blades extended along the radial direction through the flowpath, wherein the plurality of compressor blades is surrounded by the outer radial wall, and wherein the first vane and the second vane are positioned at the compressor section.

15. The system of any one or more clauses herein, the system including a fan section including a plurality of fan blades, wherein the plurality of fan blades is extended along the radial direction through a fan flow passage; and a compressor section including a plurality of compressor blades extended along the radial direction through the flowpath, wherein the flowpath separates into a core flowpath in fluid communication with a heat addition system, and wherein the flowpath separates into a third stream flowpath in fluid communication with the fan flow passage downstream of the plurality of fan blades.

16. The system of any one or more clauses herein, the system including a fan section including a plurality of fan blades, wherein the plurality of fan blades is extended along the radial direction through a fan flow passage; and a core engine, wherein an outer casing surrounds the core engine, wherein the first vane and the second vane are extended from the outer casing aft of the plurality of fan blades.

17. The system of any one or more clauses herein, wherein the fan section is unducted, and wherein the plurality of fan blades forms an open rotor configuration.

18. The system of any one or more clauses herein, the system including a supply conduit configured to allow a flow of a thermal load into the heat exchanger; and a return conduit configured to remove the flow of the thermal load from the heat exchanger, wherein the flow of fluid in fluid communication with the heat exchanger is a flow of oxidizer, and wherein the heat exchanger allows the flow of oxidizer into thermal communication with the flow of the thermal load.

19. The system of any one or more clauses herein, wherein the flow of the thermal load is one or more of a flow of lubricant, a flow of fuel, a flow of hydraulic fluid, or a flow of heat transfer fluid.

20. The system of any one or more clauses herein, the system including an actuation system configured to rotate the first vane along the vane axis.

What is claimed is:

1. A propulsion system, the system defining an axial centerline axis, an axial direction co-directional to the centerline axis, a radial direction extended from the centerline axis, and a circumferential direction extended relative to the centerline axis, the system comprising:

a first vane extended along the radial direction, and wherein the first vane is configured to rotate relative to a vane axis extended along the radial direction;

a second vane extended along the radial direction, and wherein the second vane is positioned aft along the axial direction of the first vane, wherein the second vane forms an inlet opening proximate to a second vane leading edge, and wherein the second vane forms an outlet opening proximate to a second vane trailing edge, wherein the inlet opening and the outlet opening together allow a flow of fluid through the second vane; and a heat exchanger positioned within the second vane, wherein the inlet opening and the outlet opening allow the flow of fluid in fluid communication with the heat exchanger.

2. The system of claim 1, wherein the first vane is configured to direct the flow of fluid into the inlet opening of the second vane via rotation of the first vane along the vane axis to a closed position.

3. The system of claim 2, wherein the first vane is configured to direct the flow of fluid away from the inlet opening of the second vane via rotation of the first vane along the vane axis to an open position.

4. The system of claim 1, the system comprising a plurality of the first vane positioned in circumferential arrangement.

5. The system of claim 4, the system comprising a plurality of the second vane positioned in circumferential arrangement.

6. The system of claim 1, wherein the inlet opening is positioned through a pressure side of the second vane.

7. The system of claim 6, wherein the outlet opening is positioned through a suction side of the second vane.

8. The system of claim 1, wherein the first vane is offset along the circumferential direction from the second vane.

9. The system of claim 8, wherein a first vane trailing edge is co-axial to at least the second vane leading edge.

10. The system of claim 9, wherein the first vane trailing edge is co-axial to the inlet opening at the second vane.

11. The system of claim 1, the system comprising:

an outer radial wall extended along the axial direction; and an inner radial wall extended co-directional to the outer radial wall, wherein the outer radial wall and the inner radial wall together form a flowpath extended substantially along the axial direction, and wherein the first vane and the second vane are each extended along the radial direction through the flowpath.

12. The system of claim 11, wherein the outer radial wall and the inner radial wall form an inlet section configured to receive the flow of fluid into the flowpath.

13. The system of claim 11, the system comprising:

a fan section comprising a plurality of fan blades, wherein a nacelle surrounds the plurality of fan blades, and wherein the outer radial wall is formed at the nacelle, and wherein the first vane and the second vane are positioned aft along the axial direction of the plurality of fan blades; and a core engine, wherein an outer casing surrounds the core engine, and wherein the inner radial wall is formed at the outer casing.

14. The system of claim 11, the system comprising:

a compressor section comprising a plurality of compressor blades extended along the radial direction through the flowpath, wherein the plurality of compressor blades is surrounded by the outer radial wall, and wherein the first vane and the second vane are positioned at the compressor section.

15. The system of claim 11, the system comprising:

a fan section comprising a plurality of fan blades, wherein the plurality of fan blades is extended along the radial direction through a fan flow passage; and a compressor section comprising a plurality of compressor blades extended along the radial direction through the flowpath, wherein the flowpath separates into a core flowpath in fluid communication with a heat addition system, and wherein the flowpath separates into a third stream flowpath in fluid communication with the fan flow passage downstream of the plurality of fan blades.

16. The system of claim 1, the system comprising:

a fan section comprising a plurality of fan blades, wherein the plurality of fan blades is extended along the radial direction through a fan flow passage; and a core engine, wherein an outer casing surrounds the core engine, wherein the first vane and the second vane are extended from the outer casing aft of the plurality of fan blades.

17. The system of claim 16, wherein the fan section is unducted, and wherein the plurality of fan blades forms an open rotor configuration.

18. The system of claim 1, the system comprising:

a supply conduit configured to allow a flow of a thermal load into the heat exchanger; and a return conduit configured to remove the flow of the thermal load from the heat exchanger, wherein the flow of fluid in fluid communication with the heat exchanger is a flow of oxidizer, and wherein the heat exchanger allows the flow of oxidizer into thermal communication with the flow of the thermal load.

19. The system of claim 18, wherein the flow of the thermal load is one or more of a flow of lubricant, a flow of fuel, a flow of hydraulic fluid, or a flow of heat transfer fluid.

20. The system of claim 1, the system comprising:

an actuation system configured to rotate the first vane along the vane axis.

* * * * *